United States Patent [19]

Ripley et al.

[11] Patent Number: 4,547,839

[45] Date of Patent: Oct. 15, 1985

[54] OUTDOOR LIGHTING FIXTURE

[76] Inventors: John F. Ripley; Bernice D. Ripley, both of 2 Forecastle Dr., New Port Richey, Fla. 33552

[21] Appl. No.: 665,620

[22] Filed: Dec. 20, 1984

Related U.S. Application Data

[62] Division of Ser. No. 516,478, Jul. 25, 1983, abandoned.

[51] Int. Cl.[4] ..... F21S 5/00

[52] U.S. Cl. ..... 362/216; 362/260; 362/267

[58] Field of Search ..... 362/216, 260, 267, 158, 362/347-351, 443

[56] References Cited

U.S. PATENT DOCUMENTS

| | | | |
|---|---|---|---|
| 2,813,970 | 11/1957 | Lester | 362/267 |
| 2,907,870 | 10/1959 | Calmes | 362/267 |
| 3,059,137 | 10/1962 | Reaves | 362/260 |
| 3,191,087 | 6/1965 | Sugiyama et al. | 362/216 |
| 3,218,446 | 11/1965 | Langer | 362/267 |
| 4,141,061 | 2/1979 | Ford et al. | 362/260 |
| 4,363,083 | 12/1982 | Tanaka et al. | 362/216 |

FOREIGN PATENT DOCUMENTS

| | | | |
|---|---|---|---|
| 504137 | 7/1951 | Belgium | 362/216 |

*Primary Examiner*—Ira S. Lazarus

*Attorney, Agent, or Firm*—Stanley M. Miller

[57] ABSTRACT

An outdoor lighting fixture is disclosed for a circular fluorescent lamp. A first and second embodiments are disclosed for mounting in an upright position on a post or wall and a third and fourth embodiments are disclosed for mounting in a downward suspended position from a light socket. In the first and second embodiments, the fixture includes a base which opens upwardly in a generally circular, horizontal lip. A retainer plate envelops the lip of the base forming a weather resistant joint. The plate supports a circular fluorescent lamp in a horizontal orientation and a cylindrical, transparent shield envelops the retainer plate forming a weather resistant joint. In this manner, a circular fluorescent lamp can be operated in outdoor adverse weather environments. The third and fourth embodiments include a housing having a hollow cylindrical upper neck, a lower body and a downwardly depending shade portion which terminates in a circular skirt portion with a lens. The third embodiment includes an annular seal, compressively mounted between the lower flat surface of a first socket and the upper flat surface of a second socket, the seal mating with the inner surface of the neck of the housing. In the fourth embodiment, the body of the housing contains an electrical choke ballast. An encapsulating medium having good heat conducting properties is formed in the upper portion of the body of the housing enveloping the electrical choke ballast, to conduct heat from the ballast to the housing.

5 Claims, 10 Drawing Figures

FIG. 1
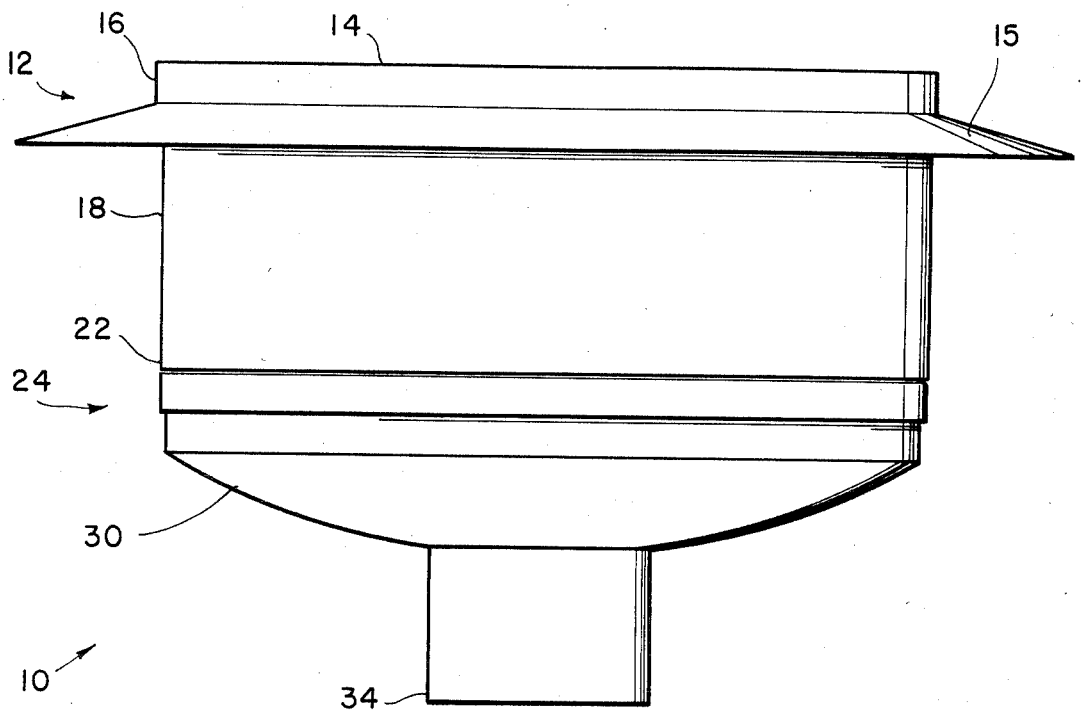
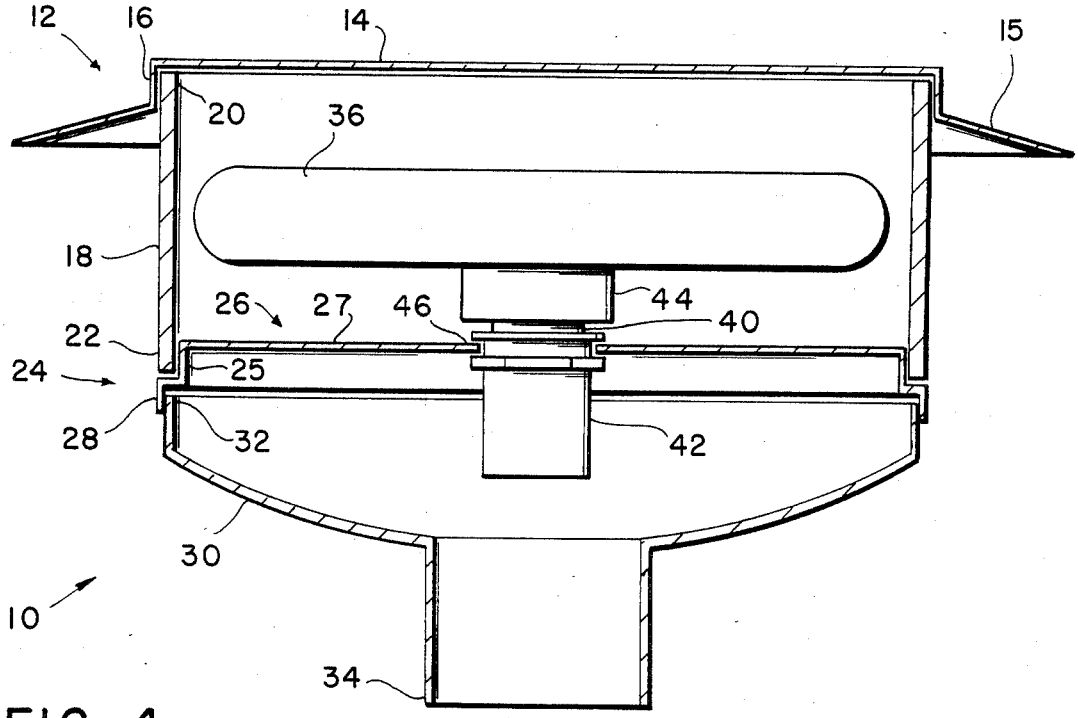
FIG. 4
SEC. 4 - 4'

FIG. 3
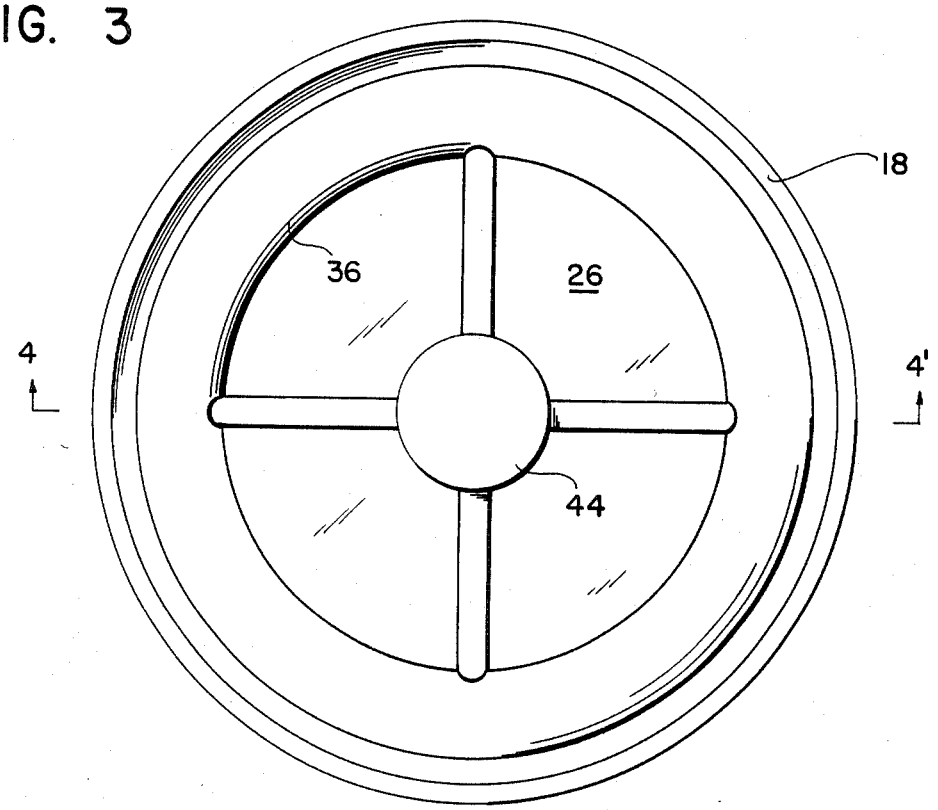
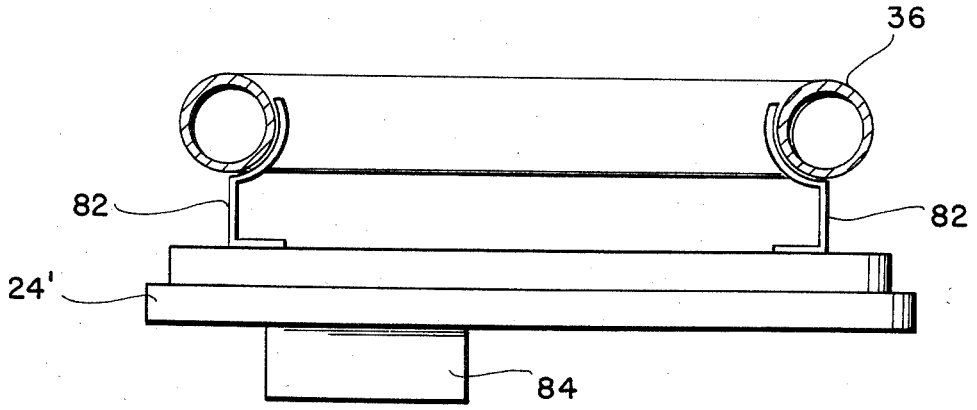
FIG. 5
SECOND EMBODIMENT

OUTDOOR LIGHTING FIXTURE

The application is a division of application Ser. No. 516,478 filed July 25, 1983 now abandoned.

FIELD OF THE INVENTION

The invention disclosed broadly relates to lighting apparatus and more particularly relates to outdoor lighting fixtures.

BACKGROUND OF THE INVENTION

Circular fluorescent lamps have been developed to provide a compact package for the high lighting efficiency fluorescent tube lamps which were previously available only in their more bulky linear tube form. Fluorescent lamps typically require auxilliary electrical apparatus such as electrical choke starters and capacitors which cannot be operated under harsh environmental conditions. The electrical components of a fluorescent lamp circuit dissipate significant quantities of heat during operation and thus the packaging of the components in prior art attempts to make them weatherproof typically resulted in their overheating which would shorten the useful life of the assembly.

OBJECTS OF THE INVENTION

It is therefor an object of the invention to provide an outdoor lighting fixture for a circular fluorescent lamp.

It is another object of the invention to provide an outdoor lighting fixture for a circular fluorescent lamp to enable the efficient production of light under harsh environmental conditions with a compact assembly.

It is a further object of the invention to effectively dissipate the heat produced by the circuit of a weatherized circular fluorescent lamp.

SUMMARY OF THE INVENTION

An outdoor lighting fixture is disclosed for a circular fluorescent lamp. A first and second embodiments are disclosed for mounting in an upright position on a post or wall and a third and fourth embodiments are disclosed for mounting in a downward suspended position from a light socket.

In the first and second embodiments, the fixture includes a base which opens upwardly in a generally circular, horizontal lip. The fixture further includes a retainer plate having a generally circular shape with a downwardly depending skirt disposed about the periphery thereof and adapted to envelop the lip of the base forming a weather resistant joint therewith, the retainer plate further including an upwardly projecting platform having a generally circular periphery and a horizontal upper surface adapted to support a circular fluorescent lamp in a horizontal and substantially coaxial orientation therewith. The fixture further includes a cylindrical shield having a generally circular shape with an upper circular edge and a lower circular edge adapted to envelop the circular periphery of the platform of the retainer plate forming a weather resistant joint therewith. The shield envelops the circular fluorescent lamp mounted on the platform of the retainer plate. The cylindrical shield is optically transparent to transmit light generated by the lamp. The fixture further includes a cover with an upper surface having a generally circular shape and a downwardly depending skirt disposed about the periphery thereof adapted to envelop the circular edge of the cylindrical shield forming a weather resistant joint therewith. In this manner, a circular fluorescent lamp can be operated in outdoor adverse weather environments.

The third and fourth embodiments of the outdoor lighting fixture for a circular fluorescent lamp include a housing having a hollow cylindrical upper neck, a downwardly depending frusto-conical body and a downwardly depending, generally hemispherical shade portion which terminates in a circular skirt portion.

In the third embodiment there is a first socket member having a cylindrical body portion adapted for mating with the upper portion of the inner surface of the neck of the housing, a threaded male electrical connector for threadably connecting to a powered light socket, and a lower flat surface having a threaded female electrical connector therein. The third embodiment also includes a second socket member having a cylindrical body portion adapted for mating with the lower portion of the inner surface of the neck of the housing, a threaded male electrical connector for threadably connecting to the female connector of the first socket member, an upper flat surface surrounding the male connector thereof, and a lower surface having a threaded female electrical connector therein, the threadably receiving a threaded male electrical connector of a circular fluorescent lamp. The third embodiment further includes an annular seal, compressively mounted between the lower flat surface of the first socket and the upper flat surface of the second socket, the seal mating with the inner surface of the neck of the housing.

The annular seal can be composed of a compressive material which expands outwardly to compressively mate with the inner surface of the neck of the housing when the threaded male electrical connector of the second socket is threadably tightened in the threaded engagement with the first socket. The first socket is mechanically anchored in the neck of the housing to enable good heat conduction therethrough from the lamp to the housing.

In the fourth embodiment of the outdoor lighting fixture, at least one mounting clip is mounted to the lower inside surface of the conical body of the housing, depending downwardly therefrom and adapted to hold a circular fluorescent lamp within the shade portion of the housing. The conical body of the housing has its upper portion containing an electrical choke ballast associated with the fluorescent lamp. The fourth embodiment has an encapsulating medium having good heat conducting properties and good electrical insulating properties, formed in the upper portion of the body of the housing and in thermal contact therewith and enveloping the electrical choke ballast, for conducting heat therethrough from the lamp and the ballast to the housing.

DESCRIPTION OF THE FIGURES

These and other objects, features and advantages will be more fully appreciated with reference to the accompanying figures.

FIG. 1 is a side, overall view of a first embodiment of the invention.

FIG. 3 is a top view of the invention shown in FIG. 1, but without the cover 12.

FIG. 4 is a side sectional view of the invention of FIG. 1, showing the relative placement of the elements thereof.

FIG. 5 is a side view of a second embodiment of the invention.

DISCUSSION OF THE PREFERRED EMBODIMENT

Figure 2:
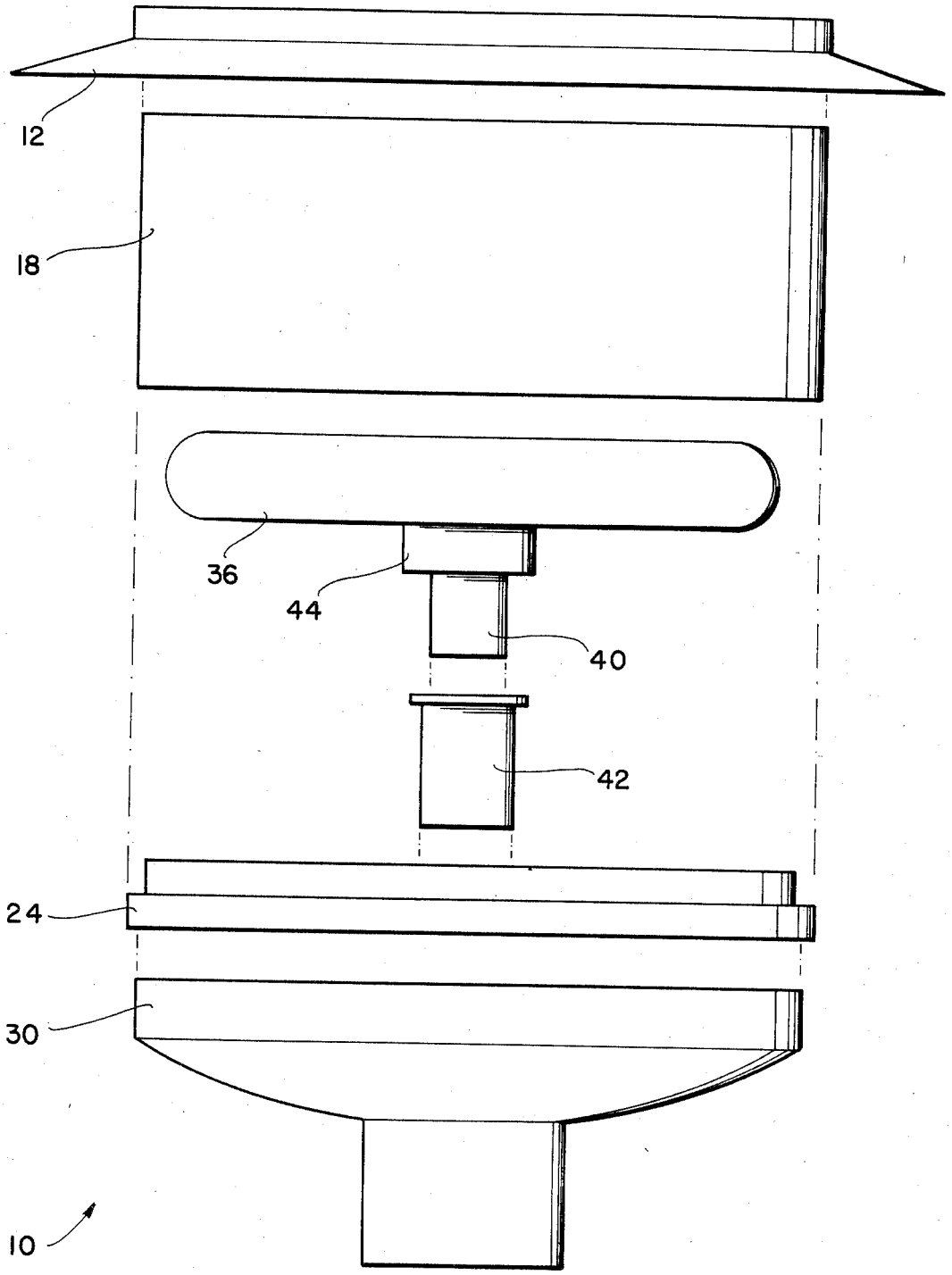
FIG. 2 is a side exploded view of the elements of the invention shown in FIG. 1.
Figure 7:
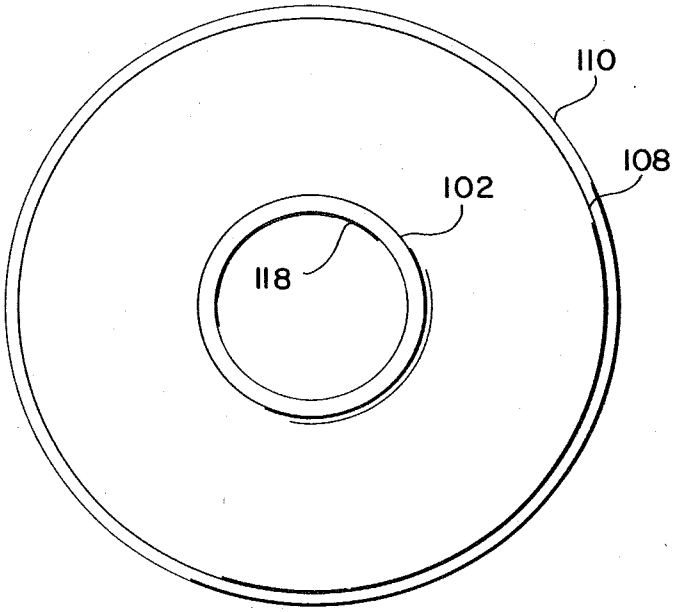
FIG. 7 is a top view of the housing shown in FIG. 6.
Figure 6:
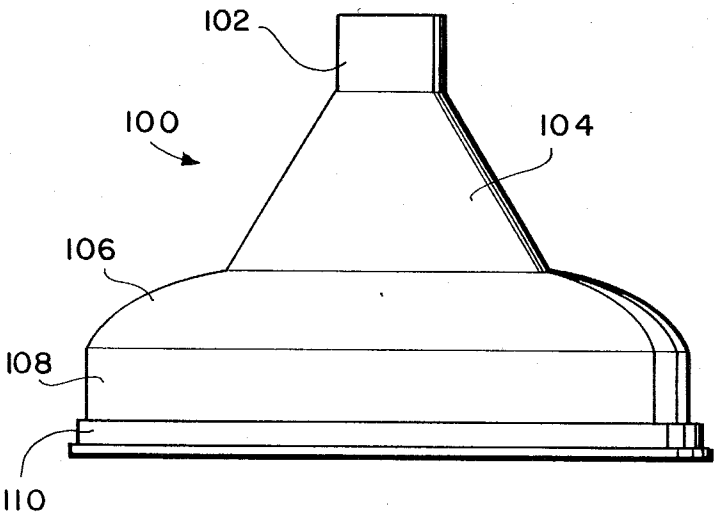
FIG. 6 is a side view of the housing for a third and fourth embodiments of the invention.

FIGS. 1 through 5 show the first and second embodiments of the outdoor lighting fixture 10 for a circular fluorescent lamp. The fixture includes a base which opens upwardly in a generally circular, horizontal lip. The fixture further includes a retainer plate having a generally circular shape with a downwardly depending skirt disposed about the periphery thereof and adapted to envelop the lip of the base forming a weather resistant joint therewith, the retainer plate further including an upwardly projecting platform having a generally circular periphery and a horizontal upper surface adapted to support a circular fluorescent lamp in a horizontal and substantially coaxial orientation therewith. The fixture further includes a cylindrical shield having a generally circular shape with an upper circular edge and a lower circular edge adapted to envelop the circular periphery of the platform of the retainer plate forming a weather resistant joint therewith. The shield envelops the circular fluorescent lamp mounted on the platform of the retainer plate. The cylindrical shield is optically transparent to transmit light generated by the lamp. The fixture further includes a cover with an upper surface having a generally circular shape and a downwardly depending skirt disposed about the periphery thereof adapted to envelop the circular edge of the cylindrical shield forming a weather resistant joint therewith. In this manner, a circular fluorescent lamp can be operated in outdoor adverse weather environments.

The outdoor lighting fixture 10 for a circular fluorescent lamp includes a base 30 having a generally hemispherical, hollow shape which opens upwardly terminating in a generally circular, horizontal lip 32, and having a mounting portion 34 at the bottom thereof adapted for attachment to a support such as a post or wall.

FIGS. 1 through 5 further show a retainer plate 24 having a generally circular shape with a downwardly depending skirt 28 disposed about the periphery thereof and adapted to envelop the lip 32 of the base 30 forming a weather resistant joint therewith which can be fastened by means of self-tapping screws. The retainer plate 24 further includes an upwardly projecting platform 26 having a generally circular periphery 25 and a horizontal upper surface 27 adapted to support a circular fluorescent lamp 36 in a horizontal and substantially coaxial orientation thereon.

FIGS. 1 through 5 further show a cylindrical shield 18 having a generally circular shape with an upper circular edge 20 and a lower circular edge 22 adapted to envelop the circular periphery 25 of the platform 26 of the retainer plate 24 forming a weather resistant joint therewith which can be fastened with self-tapping screws. The shield 18 envelops the circular fluorescent lamp 36 mounted on the platform 26 of the retainer plate 24. The cylindrical shield 18 is optically transparent to transmit light generated by the lamp 36.

FIGS. 1 through 5 further show a cover 12 with an upper surface 14 having a generally circular shape and a downwardly depending skirt 16 disposed about the periphery thereof adapted to envelop the upper circular edge 20 of the cylindrical shield 18 forming a weather resistant joint therewith which can be fastened with self-tapping screws. The cover 12 includes a shade portion 15 projecting outwardly and downwardly from the skirt 16 thereof, for deflecting precipitation and for downwardly reflecting light transmitted by the cylindrical shield 18. In this manner, a circular fluorescent lamp 36 can be operated in outdoor adverse weather environments.

A first embodiment of the invention is shown in, FIGS. 1 through 4, which has a threaded lamp socket 42 mounted in a hole 46 in the platform 26 of the retainer plate 24 and adapted for threadably mating with a threaded base 40 of the circular fluorescent lamp 36 and its integral choke starter and capacitor 44.

A second embodiment of the invention is shown in FIG. 5 wherein a spring clip 82 is mounted on the platform 26 of the retainer plate 24' and adapted for supporting the circular fluorescent lamp 36. The choke starter and capacitor assembly 84 are separately mounted to the retainer plate 24' as shown in FIG. 5.

The cylindrical shield 18 is composed of an optically transparent acrylic plastic material.

The cover 12 and the retainer plate 24 are composed of aluminum for providing strong structural support, high heat conductivity, and high optical reflection characteristics.

The resultant invention provides an outdoor lighting fixture for a circular fluorescent lamp to enable the efficient production of light under harsh environmental conditions with a compact assembly.

A third embodiment of the outdoor lighting fixture for a circular fluorescent lamp is shown in FIGS. 6 through 9. The third embodiment includes a housing 100 shown in FIGS. 6 and 7, having a hollow cylindrical upper neck 102, a downwardly depending frustoconical body 104 and a downwardly depending, generally hemispherical shade portion 106 which terminates in a circular skirt portion 108 and bottom portion 110.

Figure 8:
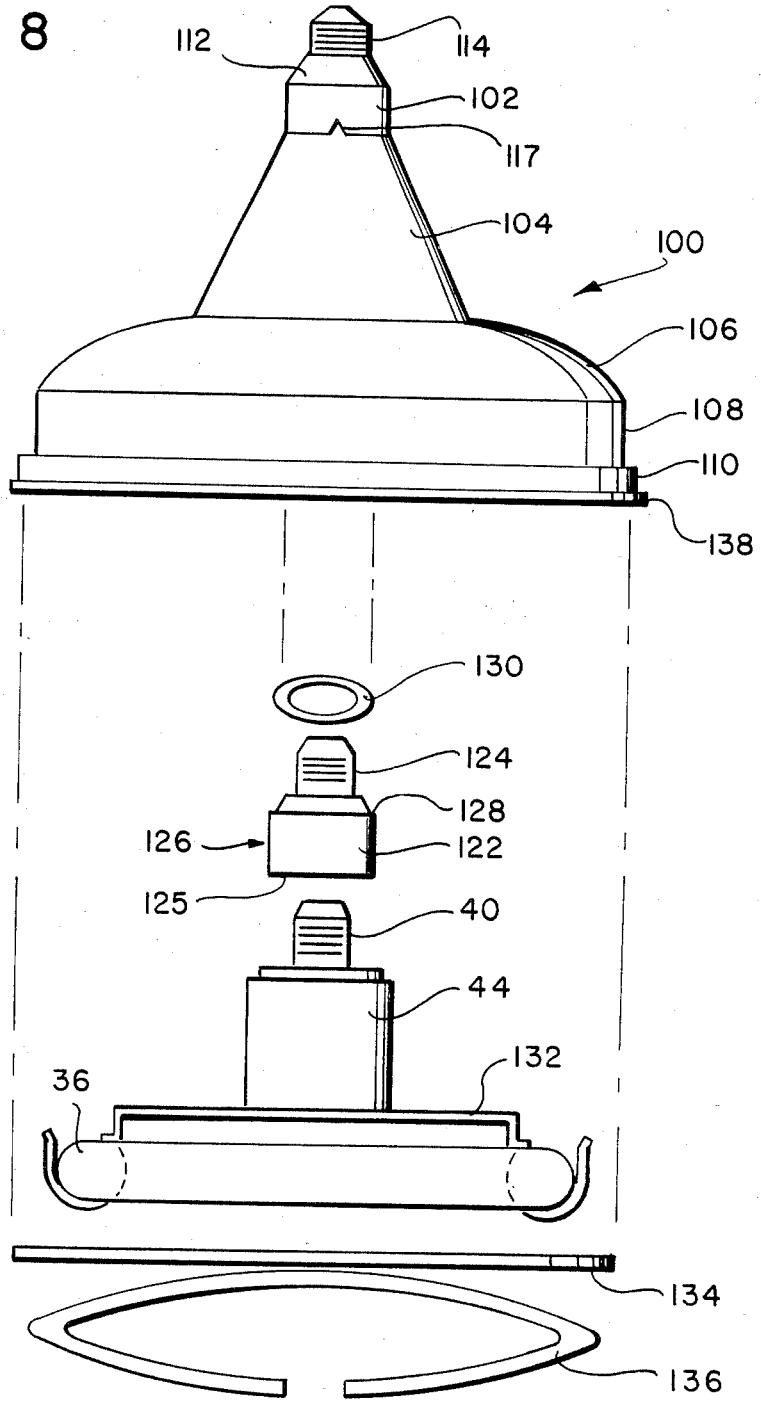
FIG. 8 is a side exploded view of the third embodiment of the invention.
Figure 9:
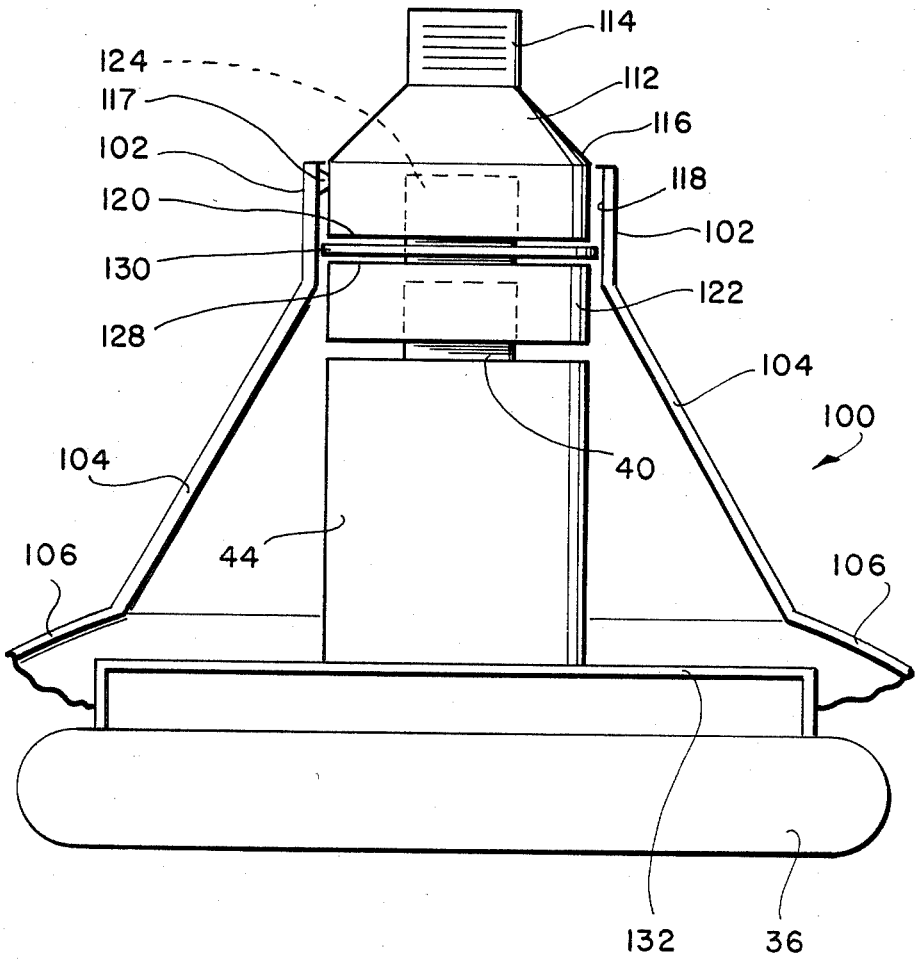
FIG. 9 is a more detailed side, breakaway view of the third embodiment of the invention.

The third embodiment further includes a first socket member 112 shown in FIGS. 8 and 9, having a cylindrical body portion 116 adapted for mating with the upper portion of the inner surface 118 of the neck 102 of the housing 100, a threaded male electrical connector 114 for threadably connecting to a powered light socket, and a lower flat surface 120 having a threaded female electrical connector therein.

The third embodiment also includes a second socket member 122 shown in FIGS. 8 and 9, having a cylindrical body portion 126 adapted for mating with the lower portion of the inner surface 118 of the neck 102 of the housing 100, a threaded male electrical connector 124 for threadably connecting to the female connector of the first socket member 112, an upper flat surface 128 surrounding the male connector 124 thereof, and a lower surface 125 having a threaded female electrical connector therein, for threadably receiving a threaded male electrical connector 40 of the circular fluorescent lamp 36. The lamp 36 is mounted by means of the bracket 132 to the cylindrical case 44 housing the ballast and other electrical components of the fluorescent lamp circuit.

The third embodiment further includes an annular seal 130 shown in FIGS. 8 and 9, compressively mounted between the lower flat surface 120 of the first socket 112 and the upper flat surface 128 of the second socket 122, the seal 130 mating with the inner surface 118 of the neck 102 of the housing 100.

In this manner, the circular fluorescent lamp can be operated in outdoor adverse weather environments.

A generally circular lens 134 is adapted to mate with the circular skirt portion 108 and 110 of the housing 100 as shown in FIG. 8. A circular retainer ring 136 is adapted to fasten the lens to the housing 100.

A circular bead 138 is disposed about the downward terminating edge of the bottom portion 110 of the housing 100, for guiding rain water off the housing 100.

The annular seal 130 can be composed of a compressible material such as a silicone rubber or a filled hydrocarbon polymer plastic such as a silica filled polycarbonate, which expands outwardly to compressively mate with the inner surface 118 of the neck 102 of the housing 100 when the threaded male electrical connector 124 of the second socket 122 is threadably tightened in the threaded engagement with the first socket 112.

The first socket 112 is mechanically anchored by means of the extrusions 117 in the neck 102 of the housing 100 to enable good heat conduction therethrough from the lamp 36 to the housing 100.

Figure 10:
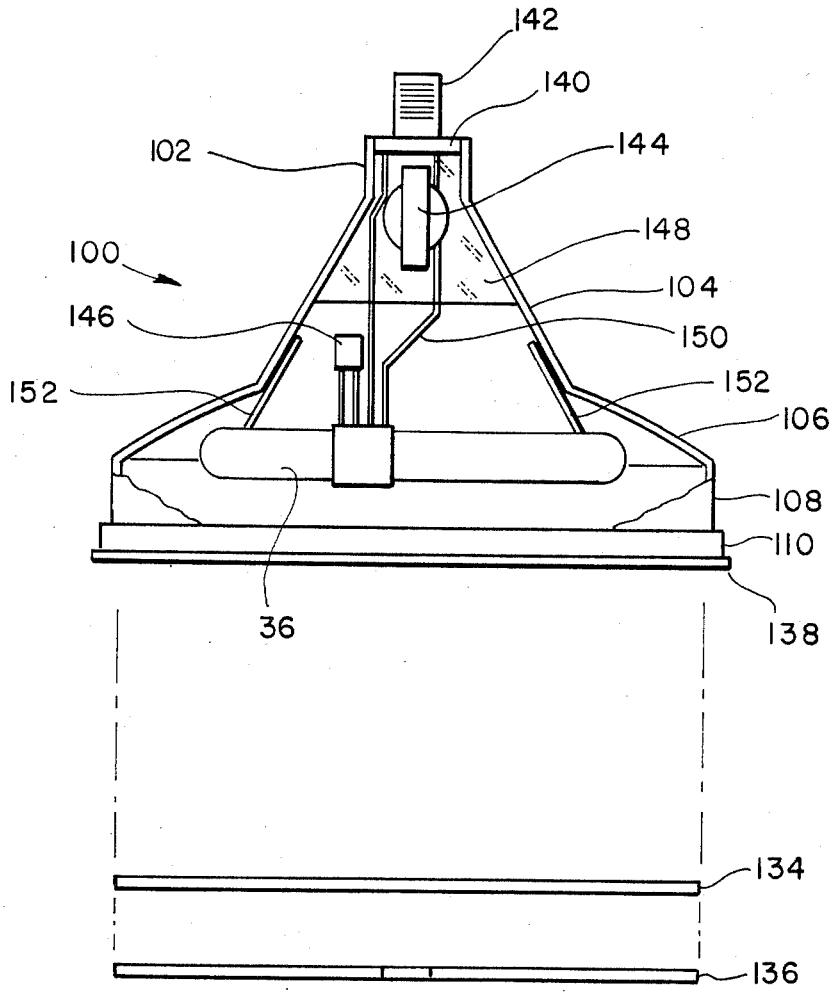
FIG. 10 is a side, breakaway view of a fourth embodiment of the invention.

The fourth embodiment of the outdoor lighting fixture for a circular fluorescent lamp is shown in FIG. 10. The fourth embodiment includes the housing 100 having a hollow cylindrical upper neck 102, a downwardly depending frusto-conical body 104 and a downwardly depending, generally hemispherical shade portion 106 which terminates in a circular skirt portion 108 and 110.

The fourth embodiment of FIG. 10 further includes at least one mounting clip 152 mounted to the lower inside surface of the conical body 104 of the housing 100, depending downwardly therefrom and adapted to hold a circular fluorescent lamp 36 within the shade portion 106 of the housing 100.

The conical body 104 of the housing 100 has its upper portion containing an electrical choke ballast 144 associated with the fluorescent lamp 36.

The fourth embodiment of FIG. 10 also includes an encapsulating medium 148 having good heat conducting properties and good electrical insulating properties, formed in the upper portion of the body 104 of the housing 100 and in thermal contact therewith and enveloping the electrical choke ballast 144, for conducting heat therethrough from the lamp 36 and the ballast 144 to the housing 100.

In this manner, the circular fluorescent lamp can be operated in outdoor adverse weather environments.

The encapsulating medium 148 can be a cured epoxy resin.

The fourth embodiment of FIG. 10 includes a generally circular lens 134 adapted to mate with the circular skirt portion 108 and 110 of the housing 100. A circular retainer ring 136 is adapted to fasten the lens to the housing 100.

A circular bead 138 disposed about the downward terminating edge of the skirt 110 of the housing 100, for guiding rain water off the housing 100.

Although specific embodiments of the invention have been disclosed, it will be understood by those having skill in the art that minor changes can be made to the disclosed embodiments without departing from the spirit and the scope of the invention.

What is claimed is:

1. An outdoor lighting fixture for a circular fluorescent lamp, comprising:

a housing having a hollow cylindrical upper neck, a downwardly depending frusto-conical body and a downwardly depending, generally hemispherical shade portion which terminates in a circular skirt portion;

a first socket member having a cylindrical body portion adapted for mating with the upper portion of the inner surface of said neck of said housing, a threaded male electrical connector for threadably connecting to a powered light socket, and a lower flat surface having a threaded female electrical connector therein;

a second socket member having a cylindrical body portion adapted for mating with the lower portion of said inner surface of said neck of said housing, a threaded male electrical connector for threadably connecting to said female connector of said first socket member, an upper flat surface surrounding said male connector thereof, and a lower surface having a threaded female electrical connector therein, for threadably receiving a threaded male electrical connector of a circular fluorescent lamp;

an annular seal, compressively mounted between said lower flat surface of said first socket and said upper flat surface of said second socket, said seal mating with said inner surface of said neck of said housing;

whereby a circular fluorescent lamp can be operated in outdoor adverse weather environments.

2. The apparatus of claim 1, which further comprises:

a generally circular lens adapted to mate with said circular skirt portion of said housing;

a circular retainer ring adapted to fasten said lens to said housing.

3. The apparatus of claim 2, which further comprises:

a circular bead disposed about the downward terminating edge of said skirt of said housing, for guiding rain water off said housing.

4. The apparatus of claim 1, wherein said annular seal is composed of a compressible material which expands outwardly to compressively mate with said inner surface of said neck of said housing when said threaded male electrical connector of said second socket is threadably tightened in said threaded engagement with said first socket.

5. The apparatus of claim 1, wherein said first socket is mechanically anchored in said neck of said housing to enable good heat conduction therethrough from said lamp of said housing.

* * * * *